United States Patent [19]

Israel et al.

[11] Patent Number: 4,884,680

[45] Date of Patent: Dec. 5, 1989

[54] COSMETIC DISPLAY

[75] Inventors: Gary Israel, West Nyack; Wayne Steenod, Monroe; Richard C. O'Mara, Westtown, all of N.Y.

[73] Assignee: Avon Products, Inc., New York, N.Y.

[21] Appl. No.: 220,930

[22] Filed: Jul. 15, 1988

Related U.S. Application Data

[63] Continuation of Ser. No. 14,970, Feb. 17, 1987.

[51] Int. Cl.[4] ..... B65D 23/12

[52] U.S. Cl. ..... 206/44.11; 206/467; 206/1.9; 206/457

[58] Field of Search ..... 206/461, 44.11, 467, 206/468, 470, 1.7, 1.9, 457

[56] References Cited

U.S. PATENT DOCUMENTS

| | | | |
|---|---|---|---|
| 3,780,856 | 12/1973 | Braverman | 206/461 |
| 3,942,640 | 3/1976 | Hellstrom | 206/461 |
| 4,030,662 | 6/1977 | Gess | 206/461 |
| 4,211,329 | 7/1980 | Braverman | 206/461 |
| 4,324,331 | 4/1982 | Ignasiak | 206/461 |
| 4,369,885 | 1/1983 | Redmond | 206/461 |
| 4,444,310 | 4/1984 | Odell | 206/461 |
| 4,648,506 | 3/1987 | Campbell | 206/461 |

*Primary Examiner*—Joseph Man-Fu Moy
*Attorney, Agent, or Firm*—S. Michael Bender

[57] ABSTRACT

Discrete quantities of actual cosmetic material are displayed or presented on the surface of a support element in separate areas or zones and maintained or protected thereon by means of an overlying transparent film or layer through which the actual or true "shades" of the different cosmetic colors or materials are rendered visible. Means are provided for facilitating manual activation of the transparent protective film or layer overlying each discrete area or zone so that the film, or a portion thereof, any be lifted or peeled away from the display element's surface. In an alternatively preferred embodiment, the sections of the display defined by the separate zones of cosmetic material are selectively separable one from the others.

1 Claim, 2 Drawing Sheets

FIG. 3
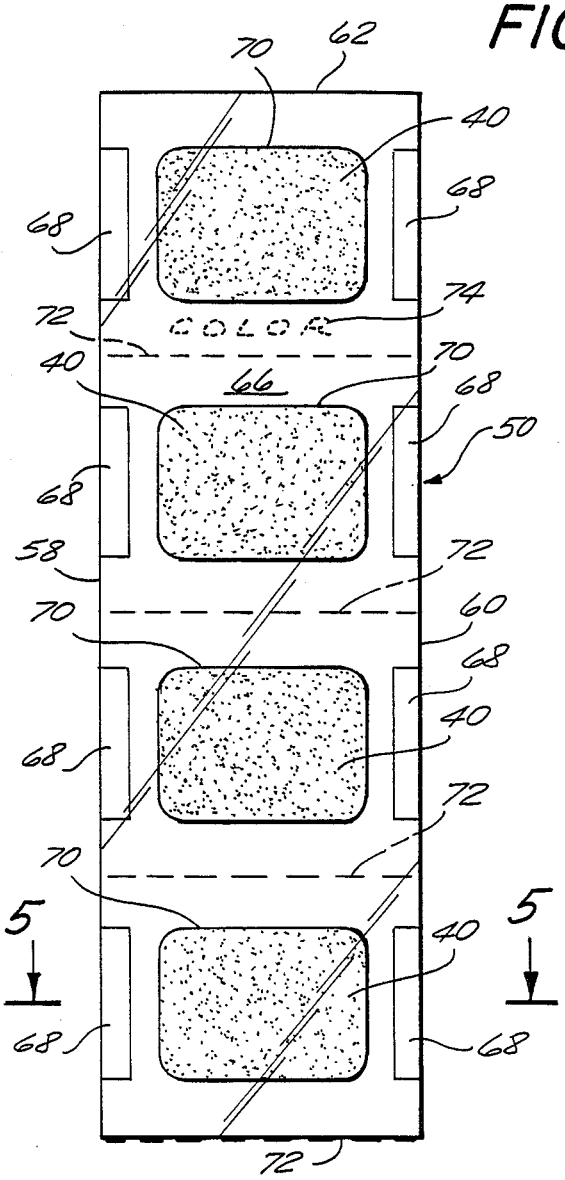
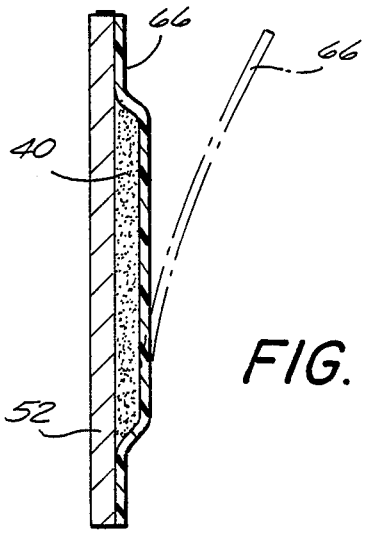
FIG. 6
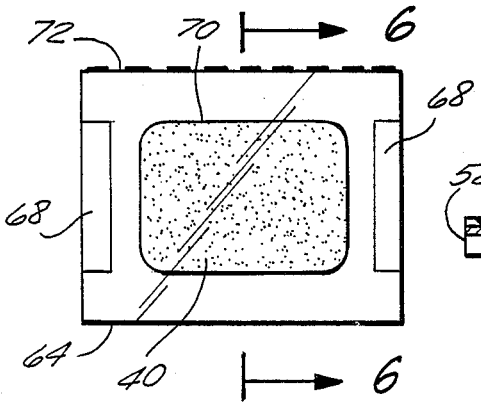
FIG. 4
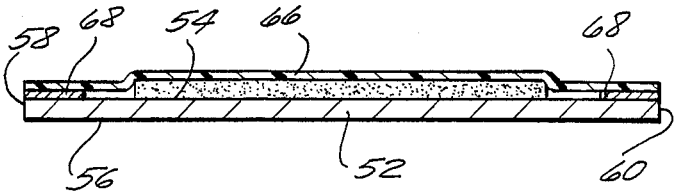
FIG. 5

COSMETIC DISPLAY

This application is a continuation of application Ser. No. 014,970, filed Feb. 17, 1987.

TECHNICAL FIELD

The present invention relates generally to articles for displaying cosmetic materials, and more specifically, to novel articles for displaying cosmetic materials in their true form and color at point of sale, or in advertising print media such as brochures, magazines, books, or newspapers.

BACKGROUND ART

In order to efficiently market certain diversely colored cosmetic products such as eyeshadow, for example, it is necessary to offer the consumer a choice or palette of many different colors or "shades". Prior efforts to display the many different color shades in a palette relating to a given cosmetic article traditionally have relied upon the use of a printed shade chart displayed either at the point of sale in the form of a counter display card, or contained on a page or insert in various printed media such as a brochure, magazine, book, or newspaper. Printed shade charts often do not reveal the exact color of the actual product and in any event do not give the consumer the opportunity to actually "try on" a sample of the actual cosmetic color product (e.g. eyeshadow) at the point of sale or elsewhere. More recently, attempts have been made to overcome the foregoing disadvantages by printing the shade chart on a display element using a slurry comprised of the actual cosmetic colored material and an ink vehicle or binder. Nevertheless, the printed slurry technique fails to present the true color of the actual cosmetic material or product, and furthermore, this technique still does not offer the consumer an opportunity to sample the actual corresponding cosmetic product before purchasing same.

DISCLOSURE OF THE INVENTION

Against the foregoing background, it has been discovered, in accordance with the present invention, that discrete quantities of actual cosmetic color material, such as, for example, eyeshadow, blush, or make-up, each being of the same or a different color or "shade" may be displayed or presented on the surface of a support element in separate areas or zones and maintained or protected thereon by means of an overlying transparent film or layer through which the actual or true "shades" of the different cosmetic colors or materials are rendered plainly visible to the consumer confronting the display element. Means are provided for facilitating manual activation of the transparent protective film or layer overlying each discrete area or zone so that the film, or a portion thereof, may be lifted or peeled away from the display element surface whereupon the consumer may sample the actual cosmetic color or material by applying a quantity thereof to the skin surface being adorned directly from the display itself and without first having to purchase the corresponding cosmetic article. The display element may be in the form of a card or "shade chart" mounted on a suitable rack of corresponding cosmetic products to be sold and appropriately positioned on, say, a sales counter in a Department Store; a page in printed media such as a brochure, magazine, book, or newspaper; a hand held display; or a strip having separable sections.

BRIEF DESCRIPTION OF DRAWINGS

The details of the present invention will be more fully described in connection with the accompanying drawing in which

FIG. 3 is a plan view of an alternatively preferred form of cosmetic display incorporating the features of the invention;

FIG. 4 is a plan view of a portion of the cosmetic display of FIG. 3;

FIG. 5 is a sectional view in elevation taken along line 5—5 of FIG. 3; and FIG. 6 is a sectional view in elevation taken along line 6—6 of FIG. 4.

BEST MODE FOR CARRYING OUT THE INVENTION

Figure 1:
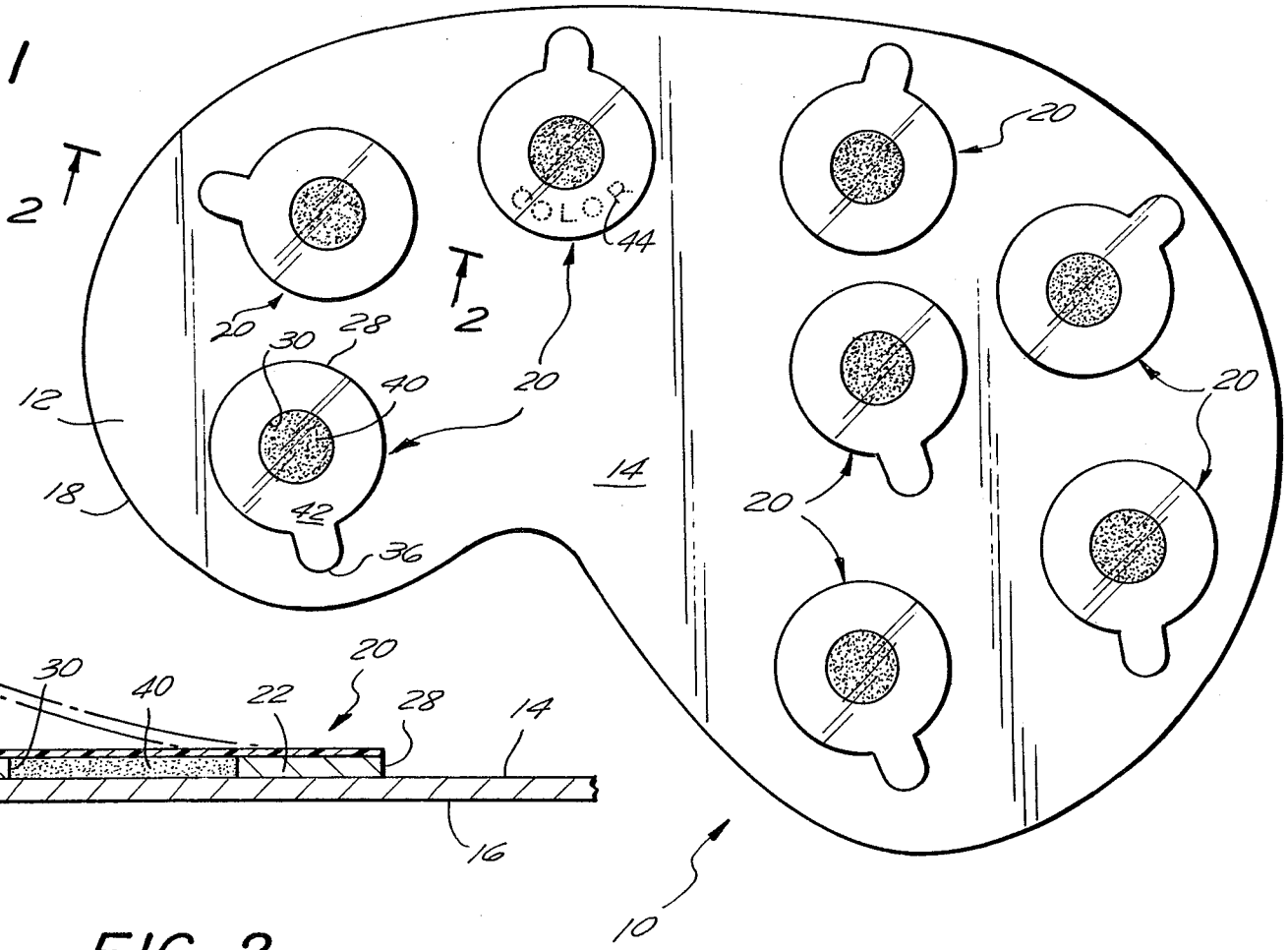
FIG. 1 is a plan view of a preferred form of cosmetic display incorporating the features of the invention.

Referring initially to FIG. 1 of the drawing, there is shown a first preferred embodiment of the invention in the form of a display element or panel generally represented by reference numeral 10. Display element 10, in turn, comprises a base sheet or ply 12 having a top surface 14, an opposed bottom surface 16 and a peripheral outer edge or boundry 18. In the preferred form illustrated, display element 10 is in the general shape of an artist's palette, but it will be understood that element 10 may be of any suitable shape sufficient to provide a supporting surface for a multiplicity of discrete, color display sections generally represented by reference numeral 20, disposed on either or both surfaces 14, 16 of base sheet 12.

While color display sections 20, in the preferred form illustrated, generally are donut shaped (i.e. circular with a central recess), here again, it will be appreciated that sections 20 may have any suitable shape such as, for example, triangular, hexagonal, rectangular, square, and so on. Likewise, the central recess in each display section may be of any shape desired so long as each color display section 20 defines or forms a discrete zone or area for displaying a corresponding color on at least one o the surfaces 14, 16 of base sheet 12. Thus, for example, if desired, a triangular shaped central recess disposed in a square-shaped display section 20 may be employed in lieu of the preferred arrangement illustrated.

Figure 2:
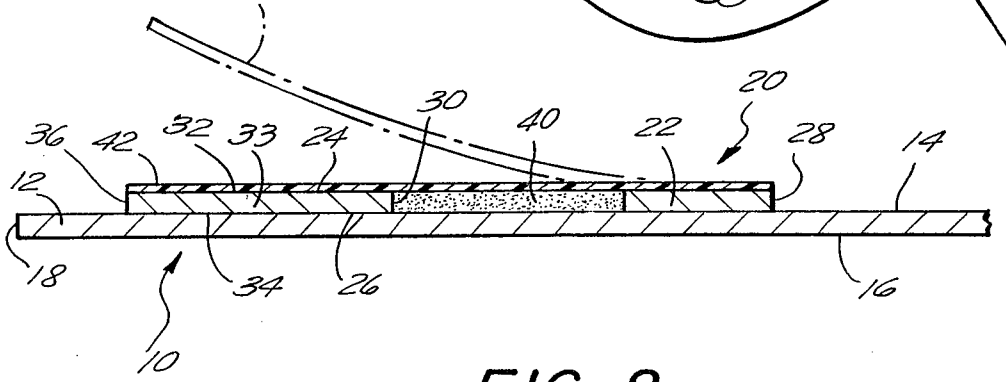
FIG. 2 is a partial section view in elevation taken along line 2—2 of FIG. 1.

As seen to better advantage in FIG. 2, the preferred form of display section 20 comprises a circular shaped member 22 having a top surface 24, an opposed bottom surface 26, and a cylindrically shaped outer peripheral wall or boundry 28. Radially spaced inwardly of outer periphery 28 is a similarly shaped cylindrical boundry or wall forming a generally circularly shaped recess or opening 30 disposed more or less centrally of display section 20. Protruding radially outwardly from outer wall 28 substantially as shown is a tab 33 having a top surface 32, an opposed bottom surface 34, and a generally U-shaped outer peripheral wall or boundry 36. Preferably, tab 33 and member 22 are integral with one another, top surface 32 is coplanar with respect to top surface 24 and bottom surface 34 is coplanar with respect to bottom surface 26. This arrangement may be achieved quite easily by die-cutting tab 33 and member 22 from the same thickness of sheet material to form section 20. The die-cut sections 20 may then be attached to surface 14 of panel 12 by applying a thin film of conventional pressure sensitive adhesive (not shown) between confronting surfaces 34, 26 on the one hand, and surface 14 on the other hand. When this is done, circular opening 30 forms a closed bottom end receptacle or concavity into which cosmetic material or color 40 may be deposited. Sufficient cosmetic material is deposited in the receptacle defined by opening 30 so as to be flush generally with upper surface 24; however, it will be appreciated that more material may be included whereupon a slight mound of cosmetic material extending beyond surface 24 will be formed. Suffice it to say, the dimensions of opening 30 and the thickness of member 22 are selected to insure that the amount or volume of cosmetic material 40 filling the receptacle will be adequate to at least permit one normal application of the material, e.g. if the cosmetic material 40 is eyeshadow, then the receptacle should include at least enough actual eyeshadow to normally adorn both eyelids of a consumer. In accordance with the invention, the cosmetic material 40 reposing in the receptacle formed by opening 30 in member 22 is the same actual cosmetic material or color offered for sale to consumers. Thus, for example, if display 10 is embodied in a corresponding cosmetic product employed to present or display a palette of eyeshadow "shades", the cosmetic material 40 may comprise a standard eyeshadow formula such as that commercially marketed under the trademark ULTRAWEAR by independent Representatives of Avon products, Inc., New York, N.Y.

In order to protect the cosmetic material 40 in the receptacle in member 22, formed by opening 30, a flexible transparent protective film or layer 42 is adhesively attached to upper surface 24 by means of a conventional pressure sensitive adhesive applied to surface 24 or alternatively, to the underside of transparent film 42 coextensive with surface 24. Preferably, no adhesive is applied to upper surface 32 of protruding tab 33, nor to the undersurface of film 42 coextensive therewith as this will facilitate easy lifting of the transparent film overlying the tab via the thumb or finger of a consumer. Hence, by grasping the portion of film 42 overlying tab 33, the transparent film or layer 42 may then be peeled away from upper surface 24 thereby exposing the cosmetic material 40 reposing in the receptacle formed in member 22. When so lifted or peeled back, transparent layer 42 will appear generally in the position indicated by broken lines in FIG. 2. In the unpeeled position illustrated in FIG. 2, transparent film 40 serves to protect and maintain the cosmetic material 40 in the receptacle in member 22, yet renders the color of the material clearly visible, i.e. the transparent material forms a window coextensive with opening 30 through which the color of the cosmetic material may be viewed.

In the palette arrangement of FIGS. 1 and 2, a multiplicity of separate color display sections 20 is positioned and affixed to upper surface 14 substantially as shown with each section 20 encapsulating cosmetic material of a different color. Obviously, the exact colors and the total number of display sections employed are matters of choice and any desired arrangement may be utilized without departing from the invention. Additionally, if desired, indicia identifying the color presented by each display section 20 may be printed or otherwise disposed on upper surface 24 adjacent to opening 30, or alternatively, on upper surface 14 adjacent to each display section 20. Other indicia revealing information about the cosmetic material being displayed, the selling price of the corresponding cosmetic product, the company marketing the corresponding cosmetic product, etc., also advantageously may be printed or otherwise marked on surface 14 of display 10 as will occur to those ordinarily skilled in the art.

In fabricating the embodiment of FIGS. 1 and 2, base sheet or ply 12 may comprise any material capable of providing a supporting surface for display sections 20. A particularly suitable material is white bleached sulfate or heavy paper stock approximately 10–12 mils thick and available commercially under the designation SBS board and/or tag stock, and is especially preferred. And although the embodiment of FIGS. 1 and 2 is in the shape of a hand held "artist's palette", other shapes may be employed as well. For example, a rectangular shaped page or chart may be used as an insert in magazines, books, or brochures. Alternatively, the various display sections 20 comprising a particular "shade" chart may be mounted directly on the paper page of a book, magazine, or newspaper. Another particularly useful arrangement would be to mount the display sections 20 on a removable card for insertion in a suitable rack either displayed on a sales counter in a Department Store, or standing alone on the floor in say, a supermarket.

The material used for the individual display sections 20 preferably is the same as that used for panel 12, but any suitable material will suffice provided it is thick enough to form the cosmetic material receiving receptacle defined by opening 30. Obviously, the storage volume of the receptacle may be increased or decreased by adjusting the size of opening 30, the thickness of member 22, or both. As for flexible transparent film 42, a particularly preferred material is a transparent plastic film having a thickness in the range of 1–2 mils and which has a pressure sensitive adhesive coating on one side thereof. Commercial embodiments of such films are sold by 3M Company under the designation 3M-1000. It will be understood however, that any suitable thin, flexible and transparent material capable of being adhesively affixed or otherwise removably secured to upper surface 24 of sections 20 may be employed instead.

Turning now to FIGS. 3–6, wherein like reference numerals represent like parts, there is shown an alternatively preferred embodiment in the form of a display panel generally represented by numeral 50. Display panel 50 comprises an elongated, relatively thin, flexible base strip 52 having a top surface 54 and an opposed bottom surface 56. The strip is bounded by opposed longitudinal edges 58, 60 and opposed transverse edges 62, 64. A flexible, transparent protective film or layer 66 is disposed coextensively on surface 54 of strip 52 and is affixed thereto preferably by means of a series of separate adhesive strips 68 spaced along longitudinal edges 58, 60 substantially as shown. As in the case of the prior preferred embodiment, the adhesive strips 68 preferably comprise a conventional pressure sensitive adhesive which may be deposited or otherwise applied either on surface 54 or the undersurface of transparent film 66 (see FIG. 5). Before attaching the transparent film 66 to base strip 52 via adhesive strips 68, a predetermined volume of cosmetic material 40 (e.g. eyeshadow) is dispensed and deposited in each one of a multiplicity of separate zones or areas on surface 54 the outline or boundry of each of which is identified by reference numeral 70 (FIGS. 3 and 4). Although adhesive strips 68 extend from edges 58, 60 transversely toward zones 70, but do not reach nor contact zones 70, and extend longitudinally parallel to edges 58, 60 coextensive only with the longitudinal extent of zones 70, it will be appreciated that this is merely the preferred arrangement and that the adhesive 68 maintaining film 66 coextensively attached to base strip 52 may be disposed therebetween in any suitable, desired manner, e.g. the entire undersurface of film 66 may be coated with a conventional pressure sensitive adhesive compound.

A series of lines of spaced perforations 72 then are formed in a conventional manner in the resulting laminate comprising base strip 52, transparent film 66, and spaced zones 70 of cosmetic material 40 therebetween, with each line of spaced perforations extending transversely of strip 52 between longitudinal edges 58, 60 and generally parallel to edges 62, 64 substantially as shown and with the perforations in each line extending commonly through base strip 52 and transparent film 66. Also, it will be noted that each line of spaced perforations 72 extends between a pair of adjacent or neighboring zones 70 of cosmetic material 40 captured between strip 52 and transparent film 66.

By the foregoing alternatively preferred method and arrangement, individual sample sections comprising one zone of cosmetic material may easily be removed from the laminated strip by tearing along a selected perforation line 72, preferably beginning with the perforation line closest to either transverse edge 62 or 64.

In this manner, separate individual sections containing a single or unitary zone of cosmetic material 40, respectively, may be given to a consumer to sample (see FIG. 4). As in the prior embodiment of FIGS. 1 and 2, a sufficient volume of cosmetic material is contained in each zone as normally would be required to apply one application of the corresponding cosmetic product, e.g. in the case of eyeshadow, enough cosmetic material to cover both eyelids.

In use, transparent film 66 is adhesively secured to base strip 52 only by the limited extent of adhesive strips 68 as explained above, and therefore, the corners or transversely extending edges of film 66 which are not adhesively secured to base strip 52 may be grasped quite easily by the finger of the hand and then peeled back or lifted to facilitate access to the cosmetic material 40 reposing in zone 70 on base strip 52 as depicted by broken lines in FIG. 6. The cosmetic material 40 then may be applied in the same manner a the corresponding cosmetic product, and the removable laminate section discarded.

It will be appreciated that panel 50 may (i) comprise as many individual removable sections or zones of cosmetic material as desired, (ii) be manufactured in indeterminate lengths and stored on a roll, for example, and/or (iii) incorporate zones of cosmetic material having any desired color. Thus, for example, the strip diagrammatically illustrated in FIGS. 3–6 may have all five zones thereof of the same color, and a plurality of different such strips, each displaying a different color may be carried by a sales representative to dispense to would be consumers. Finally, indicia 74 indicating the color of the cosmetic material in each zone 70 may be printed or otherwise marked on surface 54 or film 66 proximal to each corresponding zone 70 substantially as shown in FIG. 3. Other variations and changes within the contemplation of the present invention will occur to those of ordinary skill in the art.

The terms "cosmetic" or "cosmetic product" or "cosmetic material" as used herein, means (i) articles intended to be rubbed, poured, sprinkled, or sprayed on, introduced into, or otherwise applied to the human or animal body or any part thereof for cleaning, beautifying, promoting attractiveness, or altering the appearance, and (ii) articles intended for use as a component of any such articles, e.g. sun screening compositions, medicinal or first aid creams, and so on.

It is desired that the present invention be limited only by the true spirit and scope of the appended claims.

We claim:

1. A display for cosmetic material comprising:

a substantially flat base member;

a multiplicity of individual color display sections mounted on said base member in spaced relation to each other, each of said display sections being of smaller extent than said base member and being substantially flat to form a flexible laminate when disposed on said base member, each of said display sections having an opening therein and a transparent member co-extensively overlying at least said opening therein, a predetermined quantity of cosmetic material disposed in each of said openings between said transparent member and said base member, said predetermined quantity of cosmetic material comprising enough material to provide at least one normal application to a consumer, said transparent member being removable to permit access to said cosmetic material, and wherein said base member is in the shape of an artist's palette and said cosmetic material reposing in said openings in said display sections simulate the colors of an atrist's palette.

* * * * *